United States Patent [19]

Bailey

[11] Patent Number: 4,593,528

[45] Date of Patent: Jun. 10, 1986

[54] RAPID TRANSIENT RESPONSE CHEMICAL ENERGY POWER PLANT APPARATUS AND METHOD

[75] Inventor: David A. Bailey, Tucson, Ariz.

[73] Assignee: The Garrett Corporation, Los Angeles, Calif.

[21] Appl. No.: 779,542

[22] Filed: Sep. 24, 1985

[51] Int. Cl.[4] ..... F01K 13/02; F01K 21/00

[52] U.S. Cl. ..... 60/673; 60/649; 60/660; 60/664; 60/667; 60/721; 60/653

[58] Field of Search ..... 60/653, 649, 673, 664, 60/665, 667, 721, 660

[56] References Cited

U.S. PATENT DOCUMENTS 3,101,592 8/1963 Robertson et al. ..... 60/721 X 3,486,332 12/1969 Robertson et al. ..... 60/664 X

*Primary Examiner*—Allen M. Ostrager

*Attorney, Agent, or Firm*—Terry L. Miller; Albert J. Miller

[57] ABSTRACT

A chemical energy power plant includes control of steam temperature to prevent turbine damage while allowing throttling of the power output level and rapid response to commands for changed power output level.

23 Claims, 2 Drawing Figures

RAPID TRANSIENT RESPONSE CHEMICAL ENERGY POWER PLANT APPARATUS AND METHOD

BACKGROUND OF THE INVENTION

The present invention relates to power production systems of the type which combine chemically reactive materials in a vessel or boiler/reaction chamber to produce heat energy substantially without evolution of exhaust gasses. More particularly, the present invention relates to apparatus of the described character wherein the chemical reaction may readily be controlled or throttled so that the rate of power production may be rapidly both increased and decreased between upper and lower levels. Still more particularly, the present invention relates to method of control and operation of power plant apparatus of the described type particularly directed to obtaining both rapid response to a command for a changed power output level as well as high efficiency of operation.

The desirability of utilizing combinations of highly exothermically reactive chemical compounds to produce mechanical power without the evolution of exhaust gasses has long been recognized. By way of example, U.S. Pat. No. 1,349,969, issued Aug. 17, 1920 to W. G. Leathers describes a closed power production system utilizing thermite as the chemical power source. However, the invention of Leathers recognizes the difficulty of controlling the reaction rate of the chemical compound. Leathers seeks to allow the chemical reaction to proceed unchecked and to control the power output of the system by holding the heat energy in a controllably insulated mass. However, such a system incurs many operating difficulties and low efficiency.

Another more recent example of related technology is seen in the U.S. Pat. No. 2,484,221 issued June 25, 1946 to E. A. Gulbransen wherein magnesium salt cake is reacted with water, hydrochloric acid, and hydrogen peroxide to produce steam for driving an expanding motor. The patent to Gulbransen gives only superficial attention to control of the rate of energy production of the system. No consideration is given to obtaining rapid response transients to a command for a changed power output level.

Still another recent example of the pertinent technology is seen in U.S. Pat. No. 3,486,332, issued Dec. 30, 1969 to A. E. Robertson, et al. In the invention of Robertson et al, lithium fuel contained in a boiler/reaction chamber is combined with a reactant such as bromine pentaflouride, or sulfur hexaflouride. Only two control functions are contemplated by the Robertson et al invention. One control regulates the rate of reactant supply to the reaction chamber to maintain a selected reaction temperature. The other control regulates the rate of feed water supply to control steam pressure at a selected level. From all appearances, the Robertson et al invention contemplates steady state operation of the power system after its start-up. No provision is made either for obtaining variable power output or rapid transient response to a command for a changed level of power output. With this type of control scheme the temperature of steam supplied to the turbine is directly related to reaction chamber temperature and inversely related to feed water flow rate. Consequently, were such a system to be throttled to a low level of power production, the low water flow rate would result in excessively high steam temperature to the turbine. In order to prevent such excessive steam temperature, the temperature of the reaction chamber must be lowered. Such lowering of the reaction chamber temperature incurs undesirable consequences in the chemical reaction of the metal fuel and reactant. Also, an undesirable result is that reaction chamber temperature must generally track the power output level of the plant. The reaction chamber has considerable thermal inertia so that power output changes will necessarily lag considerably behind a command for a changed power output level.

Yet another example of conventional teaching in the relevant technology is presented by U.S. Pat. No. 3,964,416 issued June 22, 1976 to R. J. Kiraly et al. In the invention of Kiraly et al, lithium fuel is reacted with sulfur hexafluoride. Once again, as in the invention of Robertson et al, the Kiraly et al invention contemplates only two controls on the reaction system. Throttling of the reaction rate, and rapid transient response to a request for changed power output are not addressed by the Kiraly et al invention.

Two more recent U.S. patents (in terms of patent application filing date) in the relevant technology recognize, at least implicitly, some of the problems with control of the chemical reactions of interest. U.S. Pat. Nos. 3,662,740, and 3,697,239, issued May 16, 1972, and Oct. 10, 1972 to J. Schroder contemplate a heat exchanger/reaction chamber wherein a pump is utilized to move reaction products from the reaction chamber to a settling chamber. In this way the metal salts resulting from the reaction will allegedly not crust on the cooler heat transfer surfaces. However, no provision for throttling or for obtaining rapid response of the chemical reaction system to a command for a changed power output level is contemplated by the Schroder patents.

SUMMARY OF THE INVENTION

In view of the deficiencies of conventional stored chemical energy power systems, which deficiencies are particularly objectionable when an automotive vehicle is to be propelled by use of such a system, it is a primary object of the present invention to provide such a system which not only can be throttled, but which also will respond quickly to a command for a changed power output level.

Another object of the present invention is to provide power system apparatus of the above-described character further including a control apparatus regulating the power output of the chemical reaction in such a way that the level thereof may be rapidly changed.

Yet another object of the present invention is to provide a method of operating a stored chemical energy power system which provides for rapid change of energy output level.

Still another object of the present invention is to provide a method of operating a stored chemical energy power system wherein varying levels of power output can be effected with improved overall system efficiency.

Accordingly, the present invention provides a stored chemical energy power apparatus comprising a reaction chamber holding a quantity of metallic fuel, means for introducing into the reaction chamber a reactant for exothermic reaction with the fuel, heat transfer means in heat receiving relation with the fuel for heating and vaporizing a pressurized heat transfer fluid communicating therethrough, means for communicating the vaporized heat transfer fluid to an expander for producing shaft power, and means intermediate of the heat transfer means and the expander for introducing a selected quantity of relatively lower enthalpy heat transfer fluid.

The present invention further provides an apparatus of the above-described character wherein a control portion of the apparatus receives signals indicative of commanded expander power output, and actual expander power output; of commanded temperature of the vaporized heat transfer fluid, and of actual temperature of the vaporized heat transfer fluid; of commanded temperature of the reacting metallic fuel, and of actual temperature of the reacting metallic fuel; and from the foregoing producing commanded rates of supply of heat transfer fluid both to the heat transfer means, and intermediate the latter and the expander; as well as a commanded rate of supply of the reactant to the reaction chamber, which also includes an anticipatory function of the first two commanded rates of supply.

The invention also provides a method of operation of a stored chemical energy power apparatus wherein phase change fluid is passed in heat transfer relation with a reacting metallic fuel, including the steps of heating the phase change fluid to a temperature above that permissible for supply to an expander, maintaining heat transfer means of the apparatus at a minimal level of heat insulative metallic salt crust, and attemperating the phase change material from the impermissibly high temperature to a lower selected temperature prior to introduction thereof to the expander.

The invention also contemplates a method of operation of a stored chemical energy power system of the above-described character wherein a direct, rather than inverse, relationship is established between a level of reacted fuel salt crust on heat transfer surfaces of a boiler/reactor and the power output level of the system, and such salt crust increasing upon a power output increase command is utilized to assist in driving the system toward the increased level of power output as commanded.

An advantage of the present invention over conventional stored chemical energy power systems is that the temperature of steam supplied to the turbine expander is no longer directly dependent upon the temperature at which the metallic fuel reacts. The temperature of the boiler/reactor may be raised to the limit of the construction materials so as to minimize the formation of insulative metallic salt crust on relatively cool heat transfer surfaces.

Another advantage of the present invention following from the independence of temperature of stream supplied to the expander from the temperature of the reacting metal is the independence of steam temperature during transients from the rate of supply of reactant to the reactor. The reaction temperature may, therefore, be maintained at a high level without the temperature of stream supplied to the expander exceeding a desired value. It follows that because steam temperature is more independent of reaction temperature the power output of the system can be varied upwardly more readily without encountering long thermal inertia lag times common to conventional systems. Also, the chemical reaction of the fuel and reactant may take place at an advantageously high temperature.

Another advantage of the present invention appears when a transient response from a lower to a higher power output of a conventional power system, such as that taught by Robertson et al, is compared with the present invention. In the conventional power plant at a lower power output level the reaction chamber temperature will be relatively low to prevent excessive steam temperature to the turbine. Both the feed water supply rate and the feed rate of $SF_6$ will be relatively low. An insulative metallic salt crust of reaction products will exist on the cooler parts of the boiler tube. Now, to increase the power output level of the plant it is necessary to increase both the feed water supply rate and the feed rate of $SF_6$. The increased $SF_6$ flow causes a progressive increase in boiler/reactor temperature as well as in steam temperature. The superheating portion of the boiler can react directly to the increasing reactor/-boiler temperature. However, the increased feed water rate further cools the subcooled portion of the boiler tube and, it is believed, causes a temporary increase of salt crust on the boiler tube. Because the heat absorption capacity of the feed water is directly proportional to feed water rate of supply and is increased step-wise, while heat available from the fuel/$SF_6$ reaction is a time integral of $SF_6$ supply rate, the subcooled-boiling transition as well as the boiling-superheat transition move toward the boiler tube exit. Consequently, steam temperature to the turbine momentarily droops while the thermal inertia of the boiler/reactor is absorbing heat energy. The lower steam temperature will cause a decrease in turbine efficiency and a lower total energy output for the power plant. If the steam temperature to the turbine drops to the saturation point damage to the turbine may result from passage of the wet steam. Even if the rate of increase of feed water supply is limited, the thermal inertia of the boiler/reactor causes an undesirably slow response to a command for increase power output. As will be seen hereinafter, the present invention offers a considerably different response to a commanded speed change.

BRIEF DESCRIPTION OF THE DRAWING FIGURES

FIG. 1 presents in schematic form a stored chemical energy power system according to the invention;

FIG. 2 depicts schematically a control apparatus portion of a power system according to the invention.

DETAILED DESCRIPTION OF THE PREFERRED EMBODIMENT

Figure 1:
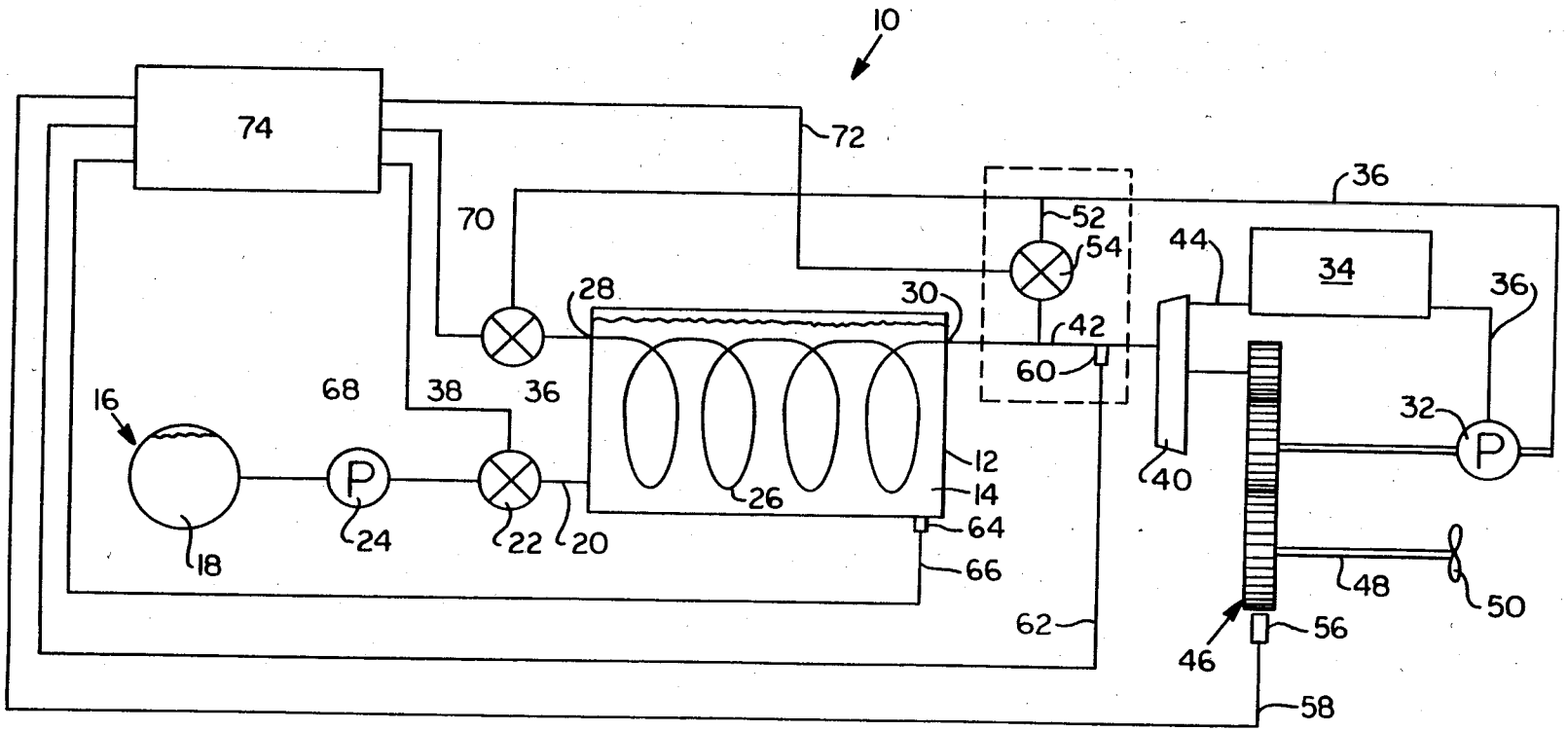

With reference to FIG. 1, there is depicted a stored chemical energy power plant apparatus 10. The apparatus includes a reaction chamber 12 which during operation of the apparatus contains a mass 14 of molten metallic fuel. By way of example only, the fuel mass 14 may be lithium, (Li). A vessel 16 is provided for holding a supply of reactant 18 communicating with the fuel mass via a conduit 20 and control valve 22. A pump 24 may be provided to deliver the reactant if such is needed. By way of further example, the reactant 18 may be sulfur hexafluoride, ($SF_6$). A monotube heat exchanger 26 passes through the fuel mass 14 in heat absorbing relation therewith and defines an inlet end 28 and outlet end 30.

In order to introduce a flow of heat transfer phase change fluid, water, for example, into the heat exhanger 26, a pump 32 is provided for drawing water from a condenser 34 and delivery thereof to the inlet 28 via a conduit 36 and water feed rate control valve 38. From the outlet 30 steam flows to a turbine 40 via a duct 42. The turbine 40 exhausts at 44 to the condenser 34. Also, the turbine 40 is coupled by gearing 46 to drive pump 32 and an output shaft 48. By way of example, the output shaft 48 may drive a propeller 50. Consequently, the power plant 10 may find application, for example, to powering a life boat which may be subject to an indeterminate period of storage before its use.

Intermediate of the outlet 30 and turbine 44, the apparatus 10 also includes a conduit 52 communicating the feed water supply conduit 36 with steam duct 42, and a tempering water control valve 54 interposed in the conduit 52. In order to complete this explanation of the apparatus 10, it must be noted that the latter also includes a turbine speed sensor 56 providing a signal analogous to turbine speed ($N_T$) on a sensing conductor 58, a steam temperature sensor 60 providing a signal analogous to turbine inlet steam temperature ($T_S$) on a signal line 62, and a reactor temperature sensor 64 providing a signal analogous to temperature of fuel mass 14 ($T_F$) on a sensing line 66. The valves 22, 38 and 54 also have associated therewith respective control signal lines 68, 70, and 72 whereby the opening and closing of each valve may be controlled by respective control signals supplied thereto. The lines 58, 62, 66, 68, 70, and 72 all connect with a control portion 74 of the power plant apparatus 10.

Figure 2:
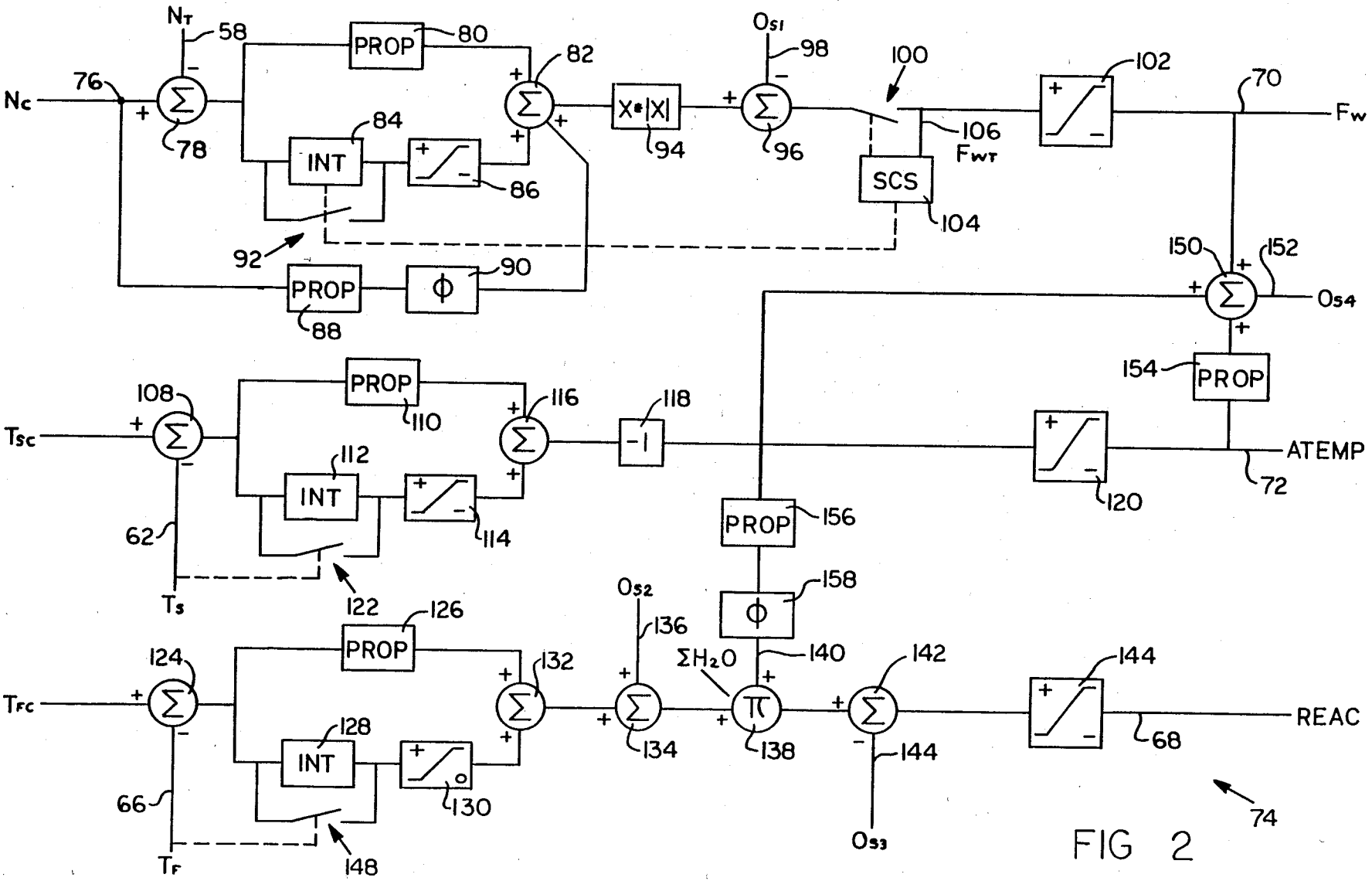

Turning now to FIG. 2, the control portion 74 is schematically depicted in greater detail. Control 74 includes a node 76 to which is supplied a signal $N_C$ analogous to a selectively variable commanded speed of the turbine 40. The signal $N_C$ is passed to a summing junction 78 to which is applied as a negative value also the signal $N_T$ via sensing line 58. From junction 78 the resulting difference signal is communicated via a proportional amplifier 80 to another summing junction 82. Also, the signal from junction 78 is conveyed via an integrator 84 and limit circuit 86 to junction 82. From node 76 upstream of summing junction 78, a corrective adder signal is obtained via a proportional amplifier 88 and a time variant buffer amplifier 90. This corrective adder signal is also applied to summing junction 82. Those skilled in the pertinent art will recognize that elements 80–86 comprise a proportional-plus-integral controller, to which is added an open loop anticipator circuit comprising elements 88 and 90. The circuit also includes a switch 92, which when closed latches the integrator 84 at a zero value.

From junction 82 the resulting signal is transferred via a sign maintaining squaring circuit 94 which multiplies the signal value (X) by the absolute value of the signal value $|X|$ to obtain a signal squared value of the same sign as the signal applied to the circuit 94. The resulting signal is applied positively to a summing junction 96 which also receives an offset signal $OS_1$ of opposite sign via conductor 98. From junction 96 the resulting signal is conducted via a switch 100 to a limit circuit 102. Limit circuit supplies to feed water control valve 38 a control signal ($F_W$) via control signal line 70. A starting control sequencer (SCS) module 104 controls switches 92 and 100 and also, when switch 100 is open, supplies via a conductor 106 a preselected start-up valve driving signal for effecting a selected opening of feed water control valve 38 prior to turbine 40 attaining a selected threshold operating speed.

The control portion 74 also includes a summing junction 108 to which is applied a signal $T_{SC}$ indicative of a commanded temperature of steam supplied to turbine 40 as sensed at sensor 60. Also applied to junction 108 as a negative value via sensing line 62 is the signal $T_S$ analogous to actual steam temperature supplied to turbine 40. The resulting difference signal is operated upon by a proportional-plus-integral control comprising a proportional amplifier 110, an integrater 112, a limit circuit 114, and a summing junction 116. The resulting signal is conveyed by an inverter 118 to a limit circuit 120, and hence to tempering water control valve 54 as a signal (ATEMP) via control line 72. Also included is a switch 122 which is closed for start-up of power plant 10 to latch integrator 112 to a zero value. The switch is responsive to a threshold value of signal $T_S$ to open during running of the plant 10.

Also included in control portion 74 is a summing junction 124 to which is applied a signal $T_{FC}$ analogous to a commanded temperature of the fuel mass 14 in reaction chamber 12. Applied to junction 124 as a negative value via sensing line 66 is the signal $T_F$ indicative of actual temperature of fuel mass 14 as indicated by sensor 64. The resulting difference signal is operated upon by a proportional-plus-integral control comprising a proportional amplifier 126, an integrator 128, a limit circuit 130, and a summing junction 132. The resulting signal is applied to a summing junction 134 along with an offset signal $OS_2$ via a conductor 136. The resulting signal is applied to a multiplying junction 138 along with a signal ($\Sigma H_2O$) via a conductor 140. The product signal from junction 138 has applied to it another offset signal $OS_3$ as a negative value at a summing junction 142 via a conductor 144. The offset product signal is applied to $SF_6$ control valve 22 as a signal (REAC) via a limit circuit 146 and control line 68. Also included is a switch 148 which is closed for start-up of the power plant 10 to latch integrator 128 to a zero value. The switch 148 is responsive to a threshold value of signal $T_F$ to open during running of the power plant 10.

The signal $\Sigma H_2O$ is obtained from the signals $F_W$ and ATEMP via a summing junction 150 to which also is applied an offset signal $OS_4$ via conductor 152. A proportional amplifier 154 effects a reduction in the level of signal ATEMP applied to junction 150 so that a selected response ratio is established between the supply of $SF_6$ to reactor 12 and changes in the rate of supply of feed water via valve 38 and atemperating water via valve 54. The resulting summation signal from junction 150 is acted upon by a proportional amplifier 156 and a buffer amplifier 158 to produce the signal $\Sigma H_2O$ applied via conductor 140 to summing junction 138.

Having observed the structure of power plant 10 and its control portion 74, attention may now be directed to its operation. During storage of the power plant 10 in a dormant state, the lithium fuel mass 14 is solid at ambient temperature. When it is desired to begin operation of the power plant, heat energy is applied to melt and liquify the lithium fuel 14. Conventionally, the necessary heat energy is supplied by electric heating elements, or by ignition of a pyrotechnic chemical compound contained within the reactor 12 along with the lithium fuel mass 14. Upon melting of the fuel mass 14, the reactant $SF_6$ is supplied via conduit 20 and valve 22 for exothermic reaction with the lithium fuel.

Recalling FIG. 2, it will be seen that during the start-up phase of operation of power plant 10 each of the integrator latching switches 92, 122, and 148 is closed, the switch 100 is open, and the starting control sequences (SCS) 104 provides a scheduled valve opening signal ($F_W$) to feed water control valve 38. Further, during startup, the tempering water control valve 54 is maintained fully closed while the $SF_6$ control valve 22 is maintained substantially fully open. To attain completion of the start-up sequence, the SCS module 104 opens switch 92 and closes switch 100 to transfer control of feedwater control valve 38 to the remainder of control portion 74. Further, the switches 122 and 148 are closed upon sensing of the respective selected threshold temperatures for the steam supplied to turbine 40 ($T_S$) and for the fuel mass 14 ($T_F$). Consequently, the control portion 74 provides the control signals $F_W$, ATEMP, and REAC in response to sensed values $N_T$, $T_S$, and $T_F$ as well as reference values $T_{SC}$ and $T_{FC}$, and the power plant 10 enters a running phase of its operation. As noted earlier the remaining control variable $N_C$ of commanded turbine speed, and therefore of power plant power output, is selectively variable.

If the power plant 10 is to be throttled after start-up from a relatively high power level to a lower level, the control signal $N_C$ is accordingly decreased. The control portion 74 consequently decreases the signal $F_W$ to partially close feed water valve 38. After a time delay effected by buffer amplifier 158, the signal $\Sigma H_2O$ is also adjusted downwardly at junction 138 by elements 150–158. The time delay effected in decreasing the supply rate of $SF_6$ upon a downward change of power level allows for the decrease of water inventory which occurs within boiler 26 when power output is decreased, and provides energy for vaporization of the amount of water by which the inventory is decreased. It will be noted that even though the power output of plant 10 is decreased, the temperature of fuel mass 14 is maintained at a substantially constant level. Further, the lower water inventory, substantially constant temperature level of fuel mass 14, and the continuing agitation effected by $SF_6$ injection substantially prevents any increase of metallic salt encrustation on the boiler tube 26 over that which may exist at higher power levels. In fact, the salt encrustation level on boiler tube 26 is believed to decrease with decreasing power level because a smaller portion of the boiler tube 26 is devoted to subcooled (heating of liquid water) and boiling activity. The decrease in salt crust on boiler tube 26, and the required heat of fusion for the decreased salt crust, is provided also by the time delay effected by buffer amplifier 158 which delays decrease of the $SF_6$ delivery rate.

Conversely, when an increased power output level is required, the signal $N_C$ is increased. Consequently, the signal $F_W$ is also increased to proportionately open feed water control valve 38. Because the boiler tube 26 has previously been operating under conditions of lower power output two phenomenon are believed to apply which assist in a rapid transition to the increased power output level. First, a relatively large portion of the boiler tube 26 is free of the insulative metallic salt crust. As a result, the crust-free boiler tube is substantially at the same temperature as fuel mass 14. Consequently, as the now increased rate of feed water flow encounters the relatively salt free portion of the boiler tube 26, a high heat transfer rate from fuel mass 14 into the boiler tube and feed water prevails. Secondly, as the boiler tube 26 is cooled with increasing feed water flow, new salt encrustation forms on previously salt-free parts of the boiler tube. In other words, the boiler inventory of water increases, and the subcooled and boiling regions of the boiler tube enlarge. Both the enlarged subcooled and boiling regions promote salt encrustation from the molten fuel mass 14. As molten metallic salt freezes out of the fuel mass 14 on the boiler tube 26, it releases its heat of fusion to the boiler tube. Consequently, the increasing salt encrustation is believed to assist in achieving a rapid power increase transient for the power plant 10.

It will be noted that both during power decreases and power increases, the control module 74 regulates valve 54 to insure the steam supplied to turbine 40 does not exceed the desired temperature. This function of control module 74 is performed during all phases of operation of power plant 10. Consequently, the rate of feed water supply via valve 54 is reflected through elements 150, 154, 156, 158 and 138 of control module 74, and appropriately influences the feed rate of $SF_6$ via valve 22.

In order to complete this description of power plant 10, it must be noted that the applicants have found particularly beneficial results from scaling the gains of amplifier 126 and integrator 128 of control module 74 in terms inherently of $SF_6$ unit flow per second per unit flow of feed water per second per degree of temperature. In other words, the circuit elements and arrangement of control module 74 are selected so that the gain of elements 126, 128 has the form:

$$\frac{\text{lb/sec of } SF_6 \text{ per lb/sec of } H_2O}{°F.} \qquad \text{Equation 1}$$

Consequently, when the above term is operated upon by the signal from junction 124 having temperature as its units, the resulting signal at junction 132 has units of $SF_6/H_2O$. At junction 138 a multiplier having units of $H_2O$ flow is applied (the $\Sigma H_2O$ signal). Consequently, the control signal on line 68 to $SF_6$ control valve 22 inherently has units of $SF_6$. The gain factors for circuit elements 126 and 128 are derived from the physical and heat transfer parameters of reactor 12 including the fuel mass 14 and boiler tube 26.

In further explanation of the above control methodology, it must be noted that the temperature of fuel mass 14 is dependent upon the balance over time between energy released within the reaction chamber 12, and energy carried away from the fuel mass by the feed water traversing boiler tube 26 (neglecting the relatively lower enthalpy of the injected $SF_6$ and heat losses from chamber 12 controlled by insulation). The energy carried out of fuel mass 14 by feed water is proportional directly to the rate of feed water flow and the enthalpy change effected between inlet 28 and outlet 30. However, enthalpy level of the feed water delivered to inlet 28 changes only slowly, while the enthalpy level of steam supplied to turbine 40 changes substantially not at all. Further, the energy release of fuel mass 14 is proportional to the integrated $SF_6$ flow. Consequently, the variation of energy transport out of fuel mass 14 is directly dependent by analogy upon the total steam flow through turbine 40, and to the signal $\Sigma H_2O$. The temperature of fuel mass 14 can change only slowly because of the large thermal inertia of the fuel mass. However, it is desired to rapidly vary power output and feed water supply rate of the power plant. Consequently, the energy balance within fuel mass 14 may change rapidly, while the changes in temperature which reflect an energy imbalance occur much more slowly. The control module 74, therefore, effects a quickly reacting open loop control of energy balance within reaction chamber 12 via the $\Sigma H_2O$ signal and its effect on $SF_6$ delivery rate. A closed loop control of slower response rate inherently having the terms set out in equation 1 is effected by use of the $T_F$ signal utilized at junction 124, the closure of this loop being effected by the energy balance and thermal mass of fuel 14.

While the present invention has been depicted and described by reference to a particularly preferred embodiment of the invention, no limitation on the invention is implied by such reference, and none is to be inferred. The invention is intended to be limited only by the spirit and scope of the appended claims which also provide a definition of the invention.

What is claimed is:

1. Power plant apparatus comprising: reaction chamber means for containing a reactive metallic fuel; boiler tube means in association with said reaction chamber means defining an inlet, an outlet, and being disposed in heat receiving relationship with said metallic fuel; phase change liquid working fluid source means for supplying said liquid working fluid pressurized to said inlet, first feed rate control valve means for selectively regulating the rate of supply of said working fluid to said inlet; conduit means for communicating the vapor of said pressurized working fluid from said outlet to a vapor pressure expanding motor; attemperating means for communicating liquid working fluid from said source thereof to said conduit; and second feed rate control valve means for selectively regulating the rate of communication of said liquid attemperating working fluid to said conduit, reactant source means for supplying an exothermically reactive reactant to said reaction chamber means, and third reactant feed rate control valve means for selectively regulating the rate of supply of said reactant to said reaction chamber, first sensor means for producing a first signal indicative of the power output of said vapor pressure expanding motor, second sensor means for producing a second signal analogous to temperature of pressurized vapor flowing via said conduit to said expanding motor, and third sensor means for producing a third signal analogous to temperature of said metallic fuel, control means for receiving said first, second, and third signals and providing respective fourth, fifth, and sixth control signals individually to said first, second, and third control valve means for selectively variably opening and closing the latter, wherein said control means comprises first summation means for receiving said fourth and said fifth control signals and producing a seventh signal analogous to a weighted summation thereof, and multiplier means for receiving said seventh signal along with an eight signal indicative of an error value between said third signal and a selected value therefor and providing the product of said seventh and eighth signals as a ninth signal productive of said sixth control signal.

2. The invention of claim 1 wherein said control means comprises second summation means for receiving said first signal along with a command signal of power output level of said power plant and producing a first difference signal therefrom, proportional-plus-integral means for receiving said first difference signal and supplying to a third summation means a weighted value thereof plus a time integral value thereof.

3. The invention of claim 2 wherein said control means further comprises time variant correction means for receiving said commanded signal of power output level and applying to said third summation means a time variant weighted value thereof.

4. The invention of claim 2 wherein said control means further includes sign maintaining squaring means for receiving from said third summation means a respective signal (x) and producing a respective output signal having the value x times the absolute value of x, $(x \cdot |x|)$.

5. The invention of claim 1 wherein said control means comprises fourth summation means for receiving said second signal along with a selected value therefore to produce a second error value, proportional-plus-integral means providing to a fifth summation means a weighted value of said second error value plus a time integral value thereof.

6. The invention of claim 5 wherein said control means further includes signal inverting means for receiving from said fifth summation means a respective signal (x) and producing a signal having the value $(-x)$.

7. The invention of claim 1 wherein said control means further includes sixth summation means for receiving said third signal along with said selected value therefor to produce said error value, proportional-plus-integral means for providing to a seventh summation means a weighted value of said error value plus a time integral value thereof, said seventh summation means producing said eight signal.

8. The invention of claim 1 wherein said control means further includes time variant delay means for effecting a time lag on variation of said seventh signal as received at said multiplier means.

9. Control apparatus for a chemical energy power plant comprising:

first means for sensing a shaft power output of said power plant and producing a respective signal;

second means for sensing a temperature of pressurized vapor supply to a vapor pressure expanding motor producing said shaft power output and producing a respective signal;

third means for sensing a temperature analogous to reaction temperature of a metallic fuel mass of said power plant and producing a respective signal;

first control means receiving said first signal and producing a first command of liquid working fluid supply to a vaporizer of said power plant;

second control means receiving said second signal and producing a second command of liquid working fluid supply to attemperate said pressurized vapor supply to said vapor pressure expanding motor;

third control means receiving said first command and said second command along with said third signal to produce a third command of reactant supply to said metallic fuel mass.

10. The invention of claim 9 wherein said third control means further comprises time variant delay means for effecting a delay in change of both said first command and second command insofar as both effect variation in said third command.

11. The method of operating a chemical energy power plant comprising a mass of metallic fuel, a supply of reactant exothermically reacting with said metallic fuel to produce heat, a boiler tube in heat receiving relation with said metallic fuel, a source of working liquid communicating with said boiler tube to produce pressurized vapor, and a vapor pressure expanding motor receiving said pressurized vapor and producing shaft power; said method comprising the steps of:

maintaining said mass of metallic fuel in a molten reactive state at a substantially constant elevated temperature;

attemperating said pressurized vapor flowing to said motor by supply of working liquid thereto to maintain a substantially constant temperature of said pressurized vapor; and contemporaneously varying the power output of said power plant by varying the rate of communication of working liquid with said boiler tube.

12. The method of claim 11 further including the step of contemporaneously varying the power output of said power plant by varying the rate of communication of said reactant with said metallic fuel.

13. The method of control of a chemical energy power system comprising a mass of metallic fuel, a supply of reactant exothermically reacting with said metallic fuel to produce heat, a boiler tube in heat receiving relation with said metallic fuel, a source of working liquid communicating with said boiler tube to produce pressurized vapor, and a vapor pressure expanding motor receiving said pressurized vapor and producing shaft power; said method comprising the steps of:

regulating the rate of communication of said working liquid with said boiler tube in accord with a power command signal;

regulating the temperature of said pressurized vapor flowing to said vapor pressure expanding motor to a substantially constant value by attemperation with working liquid;

regulating the rate of reaction of said reactant with said metallic fuel in accord with a weighted summation of working liquid flow to said motor via said boiler and via attemperation; and further regulating the rate of reaction of said reactant with said metallic fuel to maintain a substantially constant elevated temperature thereof.

14. The method of claim 13 further including the steps of providing first and second signals indicative respectively of working liquid flow to said motor via said boiler and via attemperation; providing a third signal analogous to reaction temperature of said metallic fuel, providing control means having proportional-plus-integral control elements scaled in terms of units of reactant per unit of working liquid all divided by temperature, applying said third signal of temperature to said control means, multiplying a resultant signal from said control means having units of units of reactant per unit of working liquid by said weighted summation of said first and second signals having units of working liquid flow to produce a command signal having units of reactant flow, and utilizing said command signal to regulate the rate of reaction of said reactant with said metallic fuel.

15. The method of controlling a chemical energy power plant having a mass of molten metallic fuel exothermically reacting with a reactant so as to facilitate rapid transient response to a request for a changed power output level, said method comprising the steps of: maintaining the temperature of said molten fuel mass at a substantially constant level irrespective of power output level, maintaining the temperature of pressurized working fluid vapor generated by heat transfer from said fuel mass and communicating with a vapor pressure expanding motor also substantially constant irrespective of power output level, establishing a direct relationship between a quantity of crust of reaction products on a boiler tube of said power plant and said power output level, and utilizing the heat of fusion of said crust increasing with increasing power output level to thermally drive said power plant toward said increased power output level.

16. Control apparatus for a chemical energy power plant including a reaction chamber providing a flow of pressurized working fluid vapor, a mass of molten exothermically reactive metallic fuel within said reaction chamber, a vapor pressure expanding motor receiving said flow of pressurized working fluid vapor to produce shaft power, and means for attemperating said pressurized working fluid vapor intermediate said reaction chamber and said motor, said control apparatus comprising:

first means providing a first signal indicative of a commanded power output level of said power plant;

second means in association with said first means providing a second signal indicative of an actual power output level of said power plant;

third means deriving from said first signal and said second signal a first error signal indicative of required change in power plant power output level;

first proportional-plus-integral means providing in combination a first P-plus-I signal comprising a weighted value of said first error signal plus a time integral value thereof;

corrective adder means adding to said first P-plus-I signal a time variant weighted value of said first signal to provide a corrected P-plus-I signal;

sign maintaining squaring means receiving said corrected P-plus-I signal as a value x and producing a first output signal having the value of x multiplied by the absolute value of x, $(x \cdot |x|)$;

means for receiving the first output signal $(x \cdot |x|)$ and responsively producing a selectively valued and limited signal, $F_W$;

first valve means for receiving the signal $F_W$ and regulating the flow rate of pressurized working fluid vapor from said reaction chamber in accord therewith;

fourth means providing a fourth signal indicative of a selected temperature of said pressurized working fluid vapor flow to said motor;

fifth means providing a fifth signal indicative of actual temperature of said pressurized working fluid vapor flow to said motor;

sixth means deriving from said fourth signal and said fifth signal a second error signal indicative of required change in temperature of said pressurized working fluid vapor flow to said motor;

second proportional-plus-integral means providing in combination a second P-plus-I signal comprising a weighted value of said second error signal plus a time integral value thereof;

inverting means receiving said second P-plus-I signal as a value x and producing a second output signal having the value of negative x, $(-x)$;

means for receiving the second output signal and responsively producing a selectively limited signal, ATEMP;

second valve means for regulating an attemperating flow of liquid working fluid to said pressurized working fluid vapor intermediate said reaction chamber and said motor to effect said attemperation in accord with said ATEMP signal;

seventh means providing a seventh signal indicative of a selected temperature of said molten metallic fuel;

eighth means providing an eight signal indicative of actual temperature of said molten fuel;

ninth means deriving from said seventh signal and said eight signal a third error signal indicative of required change in temperature of said molten fuel;

third proportional-plus-integral means providing in combination a third P-plus-I signal comprising a weighted value of said third error signal plus a time integral value thereof;

summation means receiving both said $F_W$ signal and said ATEMP signal and providing a weighted summation signal thereof designated $\Sigma H_2O$;

multiplier means for receiving both said third P-plus-I signal and said $\Sigma H_2O$ signal and providing a third output signal having a value substantially equal to the product of said received signals;

means for receiving said third output signal and responsively producing a selectively valued and limited signal, REAC;

third valve means for regulating a flow of exothermically reactive reactant to said metallic fuel in response to said REAC signal.

17. The invention of claim 16 wherein said summation means further includes means for effecting a time delay in change of said $\Sigma H_2O$ signal.

18. The invention of claim 16 further including start-up subcontrol means for disabling said means for receiving said first output signal and latching said first proportional-plus-integral means at a time integral value of zero (0).

19. The invention of claim 18 wherein said start-up subcontrol means also includes means for providing a temporary substitute signal for the signal $F_W$ designated, $F_{WT}$.

20. The invention of claim 16 further including means for latching said second proportional-plus-integral means at a time integral value of zero (0).

21. The invention of claim 20 wherein said latching means includes means for initiating time integration upon the fifth signal attaining a determined value.

22. The invention of claim 16 further including means for latching said third proportional-plus-integral means at a time integral value of zero (0).

23. The invention of claim 22 wherein said latching means comprises means for initiating time integration upon the eight signal attaining a certain value.

* * * * *